US010550453B2

(12) United States Patent
Iwamoto et al.

(10) Patent No.: US 10,550,453 B2
(45) Date of Patent: Feb. 4, 2020

(54) HEAT-RESISTANT MAGNESIUM ALLOY

(71) Applicant: KURIMOTO, LTD., Osaka (JP)

(72) Inventors: Yuya Iwamoto, Osaka (JP); Yasuhide Kanatsu, Osaka (JP); Akihiko Koshi, Osaka (JP); Jinsun Liao, Osaka (JP)

(73) Assignee: KURIMOTO, LTD., Osaka (JP)

( * ) Notice: Subject to any disclaimer, the term of this patent is extended or adjusted under 35 U.S.C. 154(b) by 121 days.

(21) Appl. No.: 15/549,756

(22) PCT Filed: Feb. 24, 2016

(86) PCT No.: PCT/JP2016/055355
§ 371 (c)(1),
(2) Date: Aug. 9, 2017

(87) PCT Pub. No.: WO2016/136781
PCT Pub. Date: Sep. 1, 2016

(65) Prior Publication Data

US 2018/0016663 A1 Jan. 18, 2018

(30) Foreign Application Priority Data

Feb. 26, 2015 (JP) ..... 2015-036875

(51) Int. Cl.
*C22C 23/02* (2006.01)
*B22D 21/04* (2006.01)
*C22C 23/00* (2006.01)

(52) U.S. Cl.
CPC ..... *C22C 23/02* (2013.01); *B22D 21/04* (2013.01); *C22C 23/00* (2013.01)

(58) Field of Classification Search
CPC ..... C22C 23/02
See application file for complete search history.

(56) References Cited

FOREIGN PATENT DOCUMENTS

| | | |
|---|---|---|
| CN | 1515696 | 7/2004 |
| CN | 101440449 | 5/2009 |
| EP | 1 816 223 | 8/2007 |
| EP | 2 436 792 | 4/2012 |
| JP | 6-25790 | 2/1994 |
| JP | 2004-238676 | 8/2004 |
| JP | 2008-163393 | 7/2008 |
| JP | 2010-242146 | 10/2010 |
| WO | 2005/118900 | 12/2005 |

OTHER PUBLICATIONS

Office Action dated Mar. 28, 2018 in corresponding Chinese patent application No. 201680008767.6, with English translation of the reference list.
Extended European Search Report dated Nov. 29, 2017 in corresponding European patent application No. 16755525.
International Search Report dated Apr. 5, 2016 in International (PCT) Application No. PCT/JP2016/055355.
International Preliminary Report Patentability dated Aug. 29, 2017 in International (PCT) Application No. PCT/JP2016/055355.
Yoshiki Ishii et al., "Mg—Al—Ca—Sn—Mn-Die Casting Gokin no Koon Kyodo ni Oyobosu Ryukai Shoshutsuso no Eikyo", The Japan Institute of Light Materials Dai 123 Kai Shuki Taikai Koen Gaiyo, 2012, pp. 187-188.

*Primary Examiner* — Jessee R Roe
(74) *Attorney, Agent, or Firm* — Wenderoth, Lind & Ponack, L.L.P.

(57) ABSTRACT

An improved Al—Mn-based magnesium alloy is provided which shows excellent heat resistance, creep resistance, and mechanical strength in a balanced manner. The magnesium alloy contains 4.0% by mass or more and 8.50% by mass or less of Al; 0.1% by mass or more and 0.6% by mass or less of Mn; 1.5% by mass or more and 6.0% by mass or less of Ca; and 0.1% by mass or more and 0.5% by mass or less of Sn; the balance being Mg and unavoidable impurities.

1 Claim, No Drawings

HEAT-RESISTANT MAGNESIUM ALLOY

TECHNICAL FIELD

This invention relates to a heat-resistant magnesium alloy.

BACKGROUND ART

A magnesium alloy, which comprises magnesium and other additives such as aluminum, is lightweight and easy to work with, and is used in many fields of art. For example, AZ-series magnesium alloys, which contain Al, Mn and Zn, are high in yield strength and tensile strength, and are advantageously used where a high mechanical strength is required. AS-series magnesium alloys, which contain Al, Mn and Si, are known to have heat resistance besides the properties of the AZ-series magnesium alloys.

However, since the AS-series magnesium alloys are limited in heat resistance, magnesium alloys which further contain Ca have been developed to improve the high-temperature properties.

For example, the below-identified Patent document 1 discloses magnesium alloys containing 2-10% by weight of Al and 3.0-5.0% by weight of Ca such that the relation Ca/Al≥0.7 is met, and further containing additives selected from Zn, Mn, Zr, rare earth elements, and Si (paragraph 0017 of Patent document 1). By the actions of Si and rare earth elements, these magnesium alloys show improved heat resistance.

The below-identified Patent document 2 discloses a magnesium alloy containing 1.6-5.0% by mass of Sn, besides 3.0-9.0% by mass of Al, and 2.5-7.0% by mass of Ca, and explains that by the addition of Sn, this magnesium alloy shows improved creep properties (paragraph 0021 of Patent document 2).

PRIOR ART DOCUMENTS

Patent Documents

Patent document 1: JP Patent Publication 06-25790A
Patent document 2: JP Patent Publication 2008-163393A

SUMMARY OF THE INVENTION

Object of the Invention

While a magnesium alloy containing Ca shows improved high-temperature properties, a magnesium alloy which is high only in high-temperature physical properties is practically useless. Rather, in order for a magnesium alloy to be practically usable, it has to have other mechanical properties required for the intended use that are up to the required levels. In this regard, the magnesium alloy disclosed in Patent document 2, which contains Sn, contains an increased amount of intermetallic compounds containing Sn. Thus, while this magnesium alloy is sufficient in creep properties, its other mechanical properties, including the tensile strength and the yield strength at 0.2% offset, may be insufficient.

An object of the present invention is to provide a magnesium alloy which not only excels in high-temperature properties, but excels in as many mechanical properties as possible in a balanced manner.

Means for Achieving the Object

In order to achieve this object, the present invention provides a magnesium alloy comprising: 4.0% by mass or more and 8.50% by mass or less of Al; 0.1% by mass or more and 0.6% by mass or less of Mn; 1.5% by mass or more and 6.0% by mass or less of Ca; and 0.1% by mass or more and 0.5% by mass or less of Sn.

Sn is a metal that is relatively low in melting point, so that the addition of Sn is considered to increase the fluidity of the alloy. It was discovered that the addition of Sn by an amount within the above-defined range improved the mechanical properties, such as the tensile strength, of the alloy, while maintaining the creep properties. Especially if the Sn content is 0.10% by mass or more and 0.45% by mass or less, and more preferably, 0.10% by mass or more and 0.40% by mass or less, the alloy shows sufficiently high yield strength at 0.2% offset, in addition to sufficient tensile strength.

Advantages of the Invention

The magnesium alloy according to the present invention excels not only in high-temperature properties, but various other mechanical properties.

BEST MODE FOR EMBODYING THE INVENTION

The present invention is now described in a detailed manner.

The present invention provides a magnesium alloy containing at least Al, Mn, Ca and Sn, and excels in high-temperature properties.

The magnesium alloy according to the present invention needs to contain 4.0% by mass or more of Al, while the preferred Al content is 5.5% by mass or more. If the Al content is too low, the strength of the alloy would be insufficient. If the Al content is too low, the melting point of the magnesium alloy tends to be high, so that a high temperature is necessary to prepare the magnesium alloy, and to cast the magnesium alloy. This not only worsens workability of the alloy, but increases the possibility of metal penetration of the alloy. If the Al content is 4.0% by mass or more, workability of the alloy will improve to some extent. The addition of Al by 5.5% by mass or more will ensure sufficient workability of the alloy. However, too high an Al content will result in precipitation of a β-phase, which tends to reduce the creep resistance and the tensile strength of the alloy. Thus, the Al content needs to be 8.50% by mass or less, and is preferably 7.0% by mass or less.

The magnesium alloy according to the present invention needs to contain 0.1% by mass or more of Mn, while the preferred Mn content is 0.2% by mass or more. This is because Mn is capable of removing Fe as an impurity in the magnesium alloy in the molten state, thereby keeping the magnesium alloy sufficiently corrosion-resistant, so that too low an Mn content would cause unignorable progression of Fe-originated corrosion of the magnesium alloy. On the other hand, the Mn content needs to be 0.6% by mass or less. This is because too high an Mn content will result in increased precipitation of intermetallic compounds of Mn and Al, as well as Mn as an element, thus making the magnesium alloy brittle, and reducing its strength.

The magnesium alloy according to the present invention needs to contain 1.5% by mass or more of Ca, while the preferred Ca content is 2.0% by mass or more. This is because Ca reduces elongation of the magnesium alloy due to creeping, but if its content is less than 1.5% by mass, this effect would be insufficient. If its content is 2.0% by mass or more, the magnesium alloy would reveal high heat resistance reliably. However, too high a Ca content would increase the possibility of cracks and metal penetration during casting. Thus, the Ca content is preferably 6.0% by mass or less, more preferably 5.0% by mass or less.

The magnesium alloy according to the present invention needs to contain 0.1% by mass or more of Sn, while the preferred Sn content is 0.2% by mass or more. This is because Sn is capable of improving the tensile strength, while not reducing the creep properties, but if the Sn content is too low, the mechanical properties of the magnesium alloy would be undesirable. On the other hand, the Sn content needs to be 0.50% by mass or less, and is preferably 0.45% by mass or less, especially preferably 0.40% by mass or less. If the Sn content is more than 0.50% by mass, the tensile strength and the yield strength at 0.2% offset would be insufficient. By adjusting the Sn content to 0.45% by mass or less, the alloy would reveal its various properties, including the yield strength at 0.2% offset, in a balanced manner.

The magnesium alloy according to the present invention may contain, in addition to the above-mentioned elements, unavoidable impurities. Unavoidable impurities are elements unavoidably and unintentionally mixed into the alloy during manufacture of the alloy, or into the raw material of the alloy. Such unavoidable impurities include Si, Zn, Fe, Ni, Cu, Pb, Cd, Se and Y. The content of each of such unavoidable impurities needs to be within a range in which they would not deteriorate any property of the magnesium alloy according to the present invention, and is preferably less than 0.2% by mass, and also preferably as low as possible, especially preferably less than the detection limit.

For elements other than those listed above as unavoidable impurities, the total content of the elements in Group 2 of the periodic table proposed by International Union of Pure and Applied Chemistry other than Ca and Mg, i.e., Be, Sr, Ba and Ra, is preferably as low as possible, in particular less than 0.05% by mass. The contents of the individual ones of these elements are also preferably as low as possible, in particular less than the detection limit. This is because the above-mentioned elements in Group 2 of the above mentioned periodic table are expensive, and could push up the cost of the magnesium alloy. Another problem of Ba is that Ba reacts with Al, forming an Al—Ba compound, and since the eutectic temperature of this compound, which is 528° C., is lower than the eutectic temperature of an Al—Ca compound, which is 545° C., the Al—Ba compound decomposes before does the Al—Ca compound, thus lowering the creep resistance of the alloy. The other elements in Group 2 also could form unexpected compounds that might deteriorate the properties of the alloy.

The magnesium alloy according to the present invention can be prepared by a generally known method, using a raw material containing the above-mentioned elements. The above-mentioned mass ratios and mass percents of the elements are not the ratios and percents of the elements in the raw material, but the ratios and percents of the elements in the alloy prepared using the raw material, or a product formed by casting the alloy.

Since the magnesium alloy according to the present invention has a suitably low melting point, and thus is less likely to penetrate, it can be easily used for casting. It can be used for wrought products too. Products formed by casting or extruding the magnesium alloy according to the present invention show excellent creep resistance at high temperature.

EXAMPLES

Magnesium alloy samples according to the present invention were prepared such that the contents, in mass percent, of their elements other than Mg were as shown in Table 1. The magnesium alloy samples were then formed into alloy products having a thickness of 50 mm by gravity casting.

TABLE 1

| | mass % | | | | | | | | | Tensile strength | Yield strength at 0.2% offset | Creep | |
|---|---|---|---|---|---|---|---|---|---|---|---|---|---|
| | Al | Mn | Ca | Sn | Zn | Sr | Fe | Ni | Si | $R_m$: MPa | $R_{0.2}$: MPa | $A_f$: % | Evaluation |
| Comparative Example 1 | 5.88 | 0.38 | 1.75 | 0.00 | 0.00 | 0.00 | 0.00 | 0.00 | 0.00 | 144 | 83 | 0.06 | bad |
| Example 1 | 6.12 | 0.37 | 2.00 | 0.10 | 0.00 | 0.00 | 0.00 | 0.00 | 0.00 | 153 | 88 | 0.05 | very good |
| Example 2 | 6.10 | 0.36 | 1.95 | 0.18 | 0.00 | 0.00 | 0.00 | 0.00 | 0.00 | 155 | 86 | 0.05 | very good |
| Example 3 | 6.07 | 0.37 | 1.89 | 0.27 | 0.00 | 0.00 | 0.00 | 0.00 | 0.00 | 150 | 83 | 0.06 | very good |
| Example 4 | 6.04 | 0.38 | 1.87 | 0.39 | 0.00 | 0.00 | 0.00 | 0.00 | 0.00 | 153 | 87 | 0.06 | very good |
| Example 5 | 5.83 | 0.39 | 1.87 | 0.49 | 0.00 | 0.00 | 0.00 | 0.00 | 0.00 | 157 | 77 | 0.04 | good |
| Example 6 | 4.38 | 0.25 | 5.96 | 0.25 | 0.00 | 0.00 | 0.00 | 0.00 | 0.00 | 154 | 135 | 0.08 | very good |
| Example 7 | 6.80 | 0.54 | 2.65 | 0.26 | 0.00 | 0.00 | 0.00 | 0.00 | 0.00 | 156 | 93 | 0.06 | very good |
| Example 8 | 7.99 | 0.40 | 2.84 | 0.44 | 0.00 | 0.00 | 0.00 | 0.00 | 0.00 | 156 | 99 | 0.05 | very good |
| Comparative Example 2 | 5.98 | 0.41 | 1.87 | 0.94 | 0.00 | 0.00 | 0.00 | 0.00 | 0.00 | 141 | 77 | 0.05 | bad |
| Comparative Example 3 | 8.53 | 0.39 | 3.03 | 0.53 | 0.00 | 0.00 | 0.00 | 0.00 | 0.00 | 149 | 110 | 0.04 | bad |
| Comparative Example 4 | 3.73 | 0.35 | 1.58 | 0.33 | 0.00 | 0.00 | 0.00 | 0.00 | 0.00 | 142 | 75 | — | bad |

Test specimens prepared by machining the respective alloy products were subjected to a creep test defined under JIS Z 2271 (150204). In the test, using a creep tester Model FC-13, made by TAKES GROUP LTD., after applying a stress of 50 MPa to each test specimen at 175° C. for 100 hours, the creep elongation: $A_f$ (%) was measured.

Also, test specimens prepared by machining the respective alloy products were subjected to a tensile test defined under JIS Z 2241 (1506892-1). In the tensile test, using a universal tester (DVE-200, made by Shimadzu Corporation), the tensile strength: $R_m$, and the yield strength at 0.2% offset: $R_{0.2}$ were measured. In Table 1, "very good" indicates that the tensile strength was 150 MPa or more, and the yield strength at 0.2% offset was 80 MPa or more; "good" indicates that the tensile strength was 150 MPa or more, and the yield strength at 0.2% offset was 75 MPa or more and less than 80 MPa; and "bad" indicates that the tensile strength was less than 150 MPa.

For Comparative Example 1, of which the Sn content was less than the detection limit, the tensile strength was insufficient. Examples 1-8, which contained 0.1% by mass or more and 0.50% by mass or less of Sn, all showed sufficient tensile strength. Among them, Examples 1-4 and 6-8, which contained 0.1% by mass or more and 0.45% by mass or less of Sn, were sufficiently high in yield strength at 0.2% offset, too. For Example 5, of which the Sn content was slightly higher than the other examples, while the tensile strength was sufficiently high, the yield strength at 0.2% offset was slightly low compared with the other examples. Comparative Example 2, of which the Sn content was further higher, was insufficient both in tensile strength and yield strength at 0.2% offset. For Comparative Example 3, though the Sn and Al contents were only slightly higher than their respective upper limits, the tensile strength was insufficient. For Comparative Example 4 too, of which the Al content was less than 4.0% by mass, the tensile strength was insufficient, and the yield strength at 0.2% offset was slightly lower.

In any of the examples according to the invention, no cracks or metal penetration was observed, and there was no Fe-originated corrosion, either.

What is claimed is:

1. A magnesium alloy consisting of: 6.80% by mass or more and 8.50% by mass or less of Al; 0.1% by mass or more and 0.6% by mass or less of Mn; 1.5% by mass or more and 6.0% by mass or less of Ca; and 0.1% by mass or more and 0.26% by mass or less of Sn; the balance being Mg and unavoidable impurities.

* * * * *